US006192607B1

(12) United States Patent
Kolada et al.

(10) Patent No.: US 6,192,607 B1
(45) **Date of Patent: *Feb. 27, 2001**

(54) INSOLE ASSEMBLY FOR FOOTWEAR

(75) Inventors: Paul Perry Kolada, Bexley; Terry Michael Birchler, Westerville; Michael Joseph Painter, Delaware, all of OH (US); Stephen David Opie, Arlington; Jeffrey C. Pisciotta, North Andover, both of MA (US)

(73) Assignee: Secondwind Products, Inc, Paso Robles, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 459 days.

(21) Appl. No.: 08/834,578

(22) Filed: Apr. 7, 1997

Related U.S. Application Data

(63) Continuation of application No. 08/682,401, filed on Jul. 17, 1996, now abandoned, which is a continuation of application No. 08/491,518, filed on Jun. 19, 1995, now abandoned, which is a continuation of application No. 08/184,488, filed on Jan. 21, 1994, now abandoned, which is a continuation of application No. 08/133,577, filed on Oct. 8, 1993, now abandoned.

(51) Int. Cl.[7] ..... A43B 7/14

(52) U.S. Cl. ..... 36/145; 36/166; 36/168; 36/173; 36/179; 36/162

(58) Field of Search ..... 36/91, 145, 166, 36/168, 173, 178, 179, 181, 155, 158, 162, 44

(56) References Cited

U.S. PATENT DOCUMENTS

| | | | | |
|---|---|---|---|---|
| 717,523 | * | 1/1903 | Arrowsmith | 36/166 |
| 989,823 | * | 4/1911 | Svenson | 36/168 |
| 1,055,306 | * | 3/1913 | Arrowsmith | 36/168 |
| 1,077,871 | | 11/1913 | Connell . | |
| 1,129,039 | * | 2/1915 | Lobel et al. | 36/168 |
| 1,229,300 | * | 6/1917 | Lobel | 36/168 |
| 1,261,042 | * | 4/1918 | Lobel | 36/168 |
| 1,401,066 | | 12/1921 | Galloway . | |
| 1,468,856 | | 9/1923 | Balch . | |
| 1,558,192 | | 10/1925 | Lindgren . | |
| 1,702,012 | | 2/1929 | Lacey . | |
| 1,948,347 | | 2/1934 | Geilear . | |
| 2,022,247 | * | 11/1935 | Lobel | 36/168 |
| 2,063,625 | * | 12/1936 | Rigandi | 36/181 |
| 2,071,146 | | 2/1937 | Ward . | |
| 2,079,820 | | 5/1937 | Scott . | |
| 2,106,202 | | 1/1938 | Ahronheim . | |
| 2,114,526 | | 4/1938 | Feder . | |
| 2,119,703 | | 6/1938 | Copithorn . | |
| 2,716,295 | * | 8/1955 | Stein | 36/168 |
| 3,067,752 | * | 12/1962 | Schaller et al. | 36/145 |
| 3,233,348 | * | 2/1966 | Gilkerson | 36/44 |
| 3,825,017 | * | 7/1974 | Scrima | 36/181 |
| 4,510,700 | * | 4/1985 | Brown | 36/44 |
| 4,756,096 | * | 7/1988 | Meyer | 36/44 |
| 4,843,737 | | 7/1989 | Vorderer . | |

* cited by examiner

*Primary Examiner*—M. D. Patterson
(74) *Attorney, Agent, or Firm*—Sheldon & Mak; Denton L. Anderson

(57) ABSTRACT

An insole assembly for footwear includes a cushioning member and an underlying resilient support member. The cushioning member has an undersurface with a first region beneath a wearer's heel and a second region extending beneath a wearer's arch. The resilient support member has a body and at least one resilient cantilevered arm with a first end attached to the body and a second end extending beneath the second region of the cushioning member. The cantilevered arm defines an arch support surface in supporting engagement with the undersurface of the cushioning member.

11 Claims, 9 Drawing Sheets

INSOLE ASSEMBLY FOR FOOTWEAR

This is a continuation of application Ser. No. 08/682,401, filed on Jul. 17, 1996, now abandoned, which is a continuation of Ser. No. 08/491,518, filed Jun. 19, 1995, now abandoned, which is a continuation of Ser. No. 08/184,488, filed Jan. 21, 1994, now abandoned, which is a continuation of Ser. No. 08/133,577, filed Oct. 8, 1993, by Paul P. Kolada, Terry M. Birchler, Michael J. Painter, Stephen D. Opie and Jeffrey C. Pisciotta for INSOLE ASSEMBLY FOR FOOTWEAR, now abandoned.

BACKGROUND OF THE INVENTION

The invention relates to footwear and insole assemblies for footwear.

Footwear insoles having a resilient element to provide support beneath a region of the wearer's foot are known. Examples include those described in: Connell U.S. Pat. No. 1,077,871; Galloway U.S. Pat. No. 1,401,066; Balch U.S. Pat. No. 1,468,856; Lindgren U.S. Pat. No. 1,558,152; Lacey U.S. Pat. No. 1,702,012; Geilear U.S. Pat. No. 1,948,347; Ward U.S. Pat. No. 2,071,146; Scott U.S. Pat. No. 2,079,820; Ahronheim U.S. Pat. No. 2,106,202; Feder U.S. Pat. No. 2,114,526; Copithorn U.S. Pat. No. 2,119,703 and Vorderer U.S. Pat. No. 4,843,737.

SUMMARY OF THE INVENTION

According to one aspect of the invention, an insole assembly for footwear comprises a cushioning member and an underlying resilient support member. The cushioning member defines an undersurface having at least a first region disposed beneath a wearer's heel and a second region extending beneath a wearer's arch. The resilient support member comprises a body disposed beneath the first region of the undersurface, and at least one resilient cantilevered arm member having a first end attached to the body and a second end extending beneath the second region of the undersurface, the cantilevered arm member defining an arch support surface in supporting engagement with the undersurface.

Preferred embodiments of this aspect of the invention may include one or more of the following additional features. The cushioning member further defines an upper surface for engagement by a wearer's foot, with an upraised arch surface positioned for engagement with an arch region of the wearer's foot, the upraised arch surface positioned for resilient support by the arch support surface defined by the resilient cantilevered arm member. Preferably, the cushioning member upper surface disposed for engagement by the wearer's foot has a general contour imitating that of a bottom surface of the wearer's foot at rest. The body of the resilient support member, in the first region disposed beneath a wearer's heel, defines an aperture, and the cushioning member is adapted to engage in the aperture in a manner to secure the relative positions of the body and cushioning member. The body of the resilient support member further comprises an upstanding lip extending about a heel end of the body to engage with a side surface of the cushioning member in a manner to further secure the relative positions of the body and cushioning member. The cushioning member comprises memory elastic polymeric material, e.g. polyester elastomeric expanded foam material, and the resilient support member comprises memory elastic polymeric material, e.g. polyester elastomeric material. The resilient cantilevered arm member has an arcuate shape in a plane perpendicular to the arch support surface. The insole assembly comprises a plurality of resilient cantilevered arm members, at least one arm member being arranged for movement independent of adjacent resilient cantilevered arm members. The cantilevered arm member defines at least one through aperture which forms separate arm segments that are adapted to respond relatively independently to local stepping forces.

According to another aspect of the invention, a resilient insole support member for footwear has a first region disposed beneath a wearer's arch and a second region extending beneath a portion of the wearer's foot other than the arch and the resilient member comprises a body disposed beneath the second region, and at least one resilient cantilevered arm member having a first end attached to the body and a second end extending beneath the first region, the cantilevered arm member defining a surface imitating a contour of a bottom surface of a wearer's arch.

Preferred embodiments of this aspect of the invention may include one or more of the following additional features. The resilient insole support member comprises a plurality of resilient cantilevered arm members with at least one resilient cantilevered arm member arranged for movement independent of adjacent resilient cantilevered arm members. The resilient support member comprises memory elastic polymeric material, e.g. polyester elastomeric material. The resilient cantilevered arm member has an arcuate shape in a plane perpendicular to the arch support surface. The resilient cantilevered arm member defines at least one aperture extending through the arm member to form separate arm segments, the separate arm segments adapted to respond relatively independently to local stepping forces.

These and other features and advantages of the invention will be seen from the following description of a presently preferred embodiment, and from the claims.

BRIEF DESCRIPTION OF THE DRAWINGS

We first briefly describe the drawings.

DESCRIPTION OF PRESENTLY PREFERRED EMBODIMENTS

Figure 1:
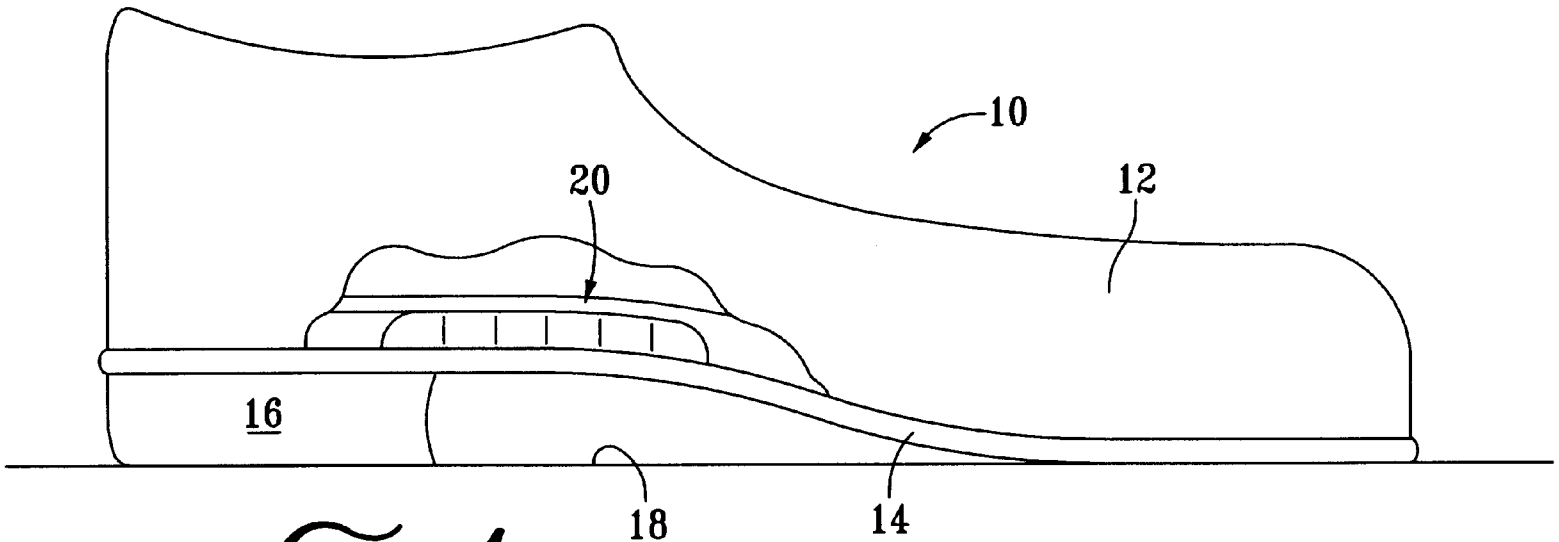
FIG. 1 is a perspective view partially in section of a shoe equipped with an insole assembly of the invention.

Referring to FIG. 1, a shoe 10 of typical construction has an upper 12 sized for receiving the foot of a wearer, with an outsole 14 and heel 16 for engaging upon the walking surface 18.

In a preferred embodiment, the shoe 10 is further equipped with one embodiment of an insole assembly 20 of the invention, which provides resilient support to the wearer's foot during walking. An insole assembly of the invention may, of course, be employed in all manner of shoes, boots and other footwear.

Figure 2:
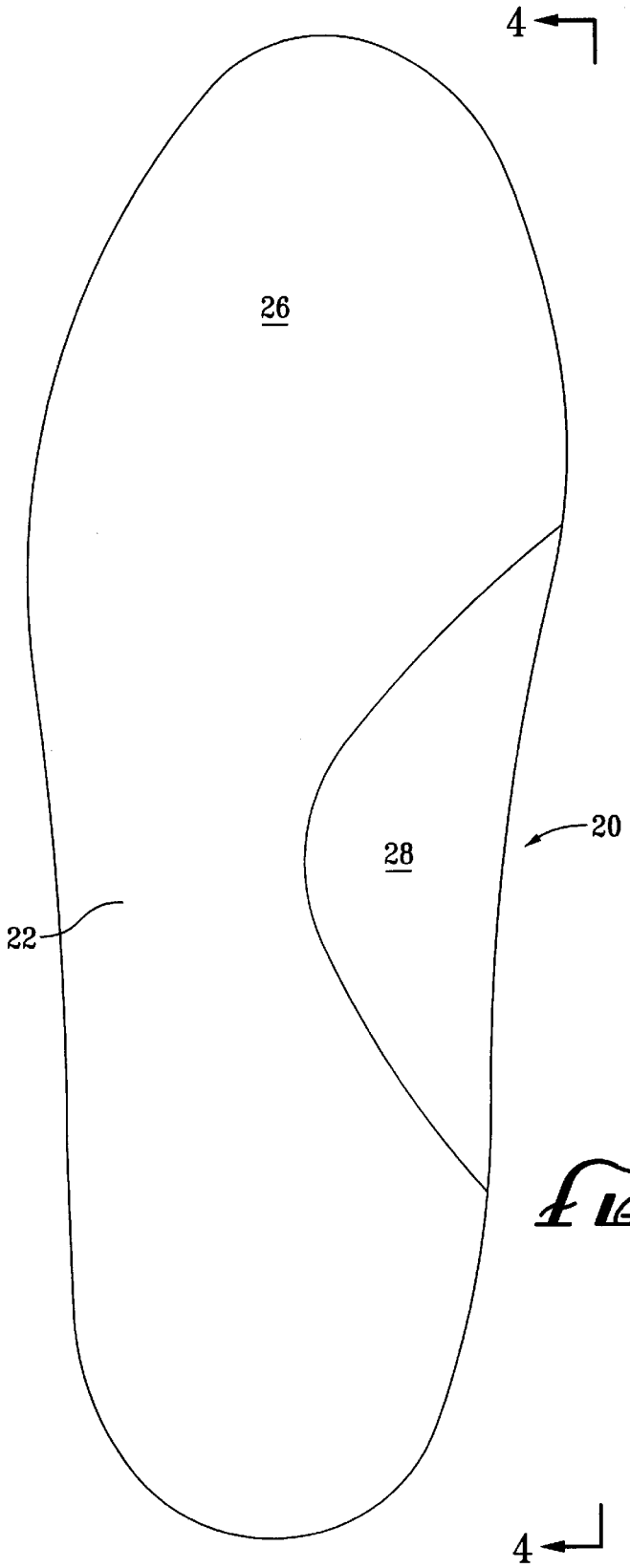
FIG. 2 is a top view of an insole assembly of the invention.
Figure 3:
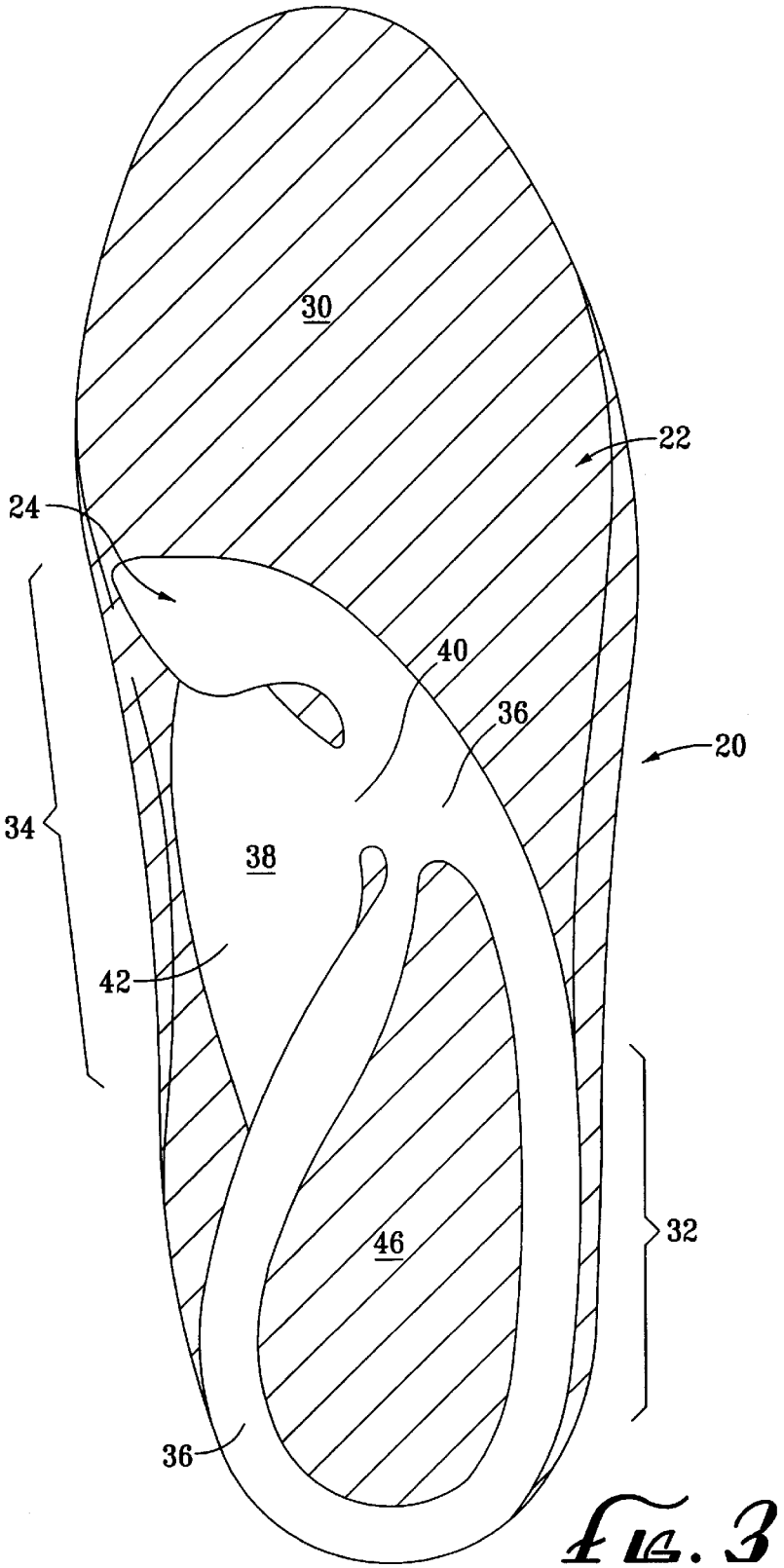
FIG. 3 is a bottom view of one embodiment of an insole assembly of the invention.
Figure 4:
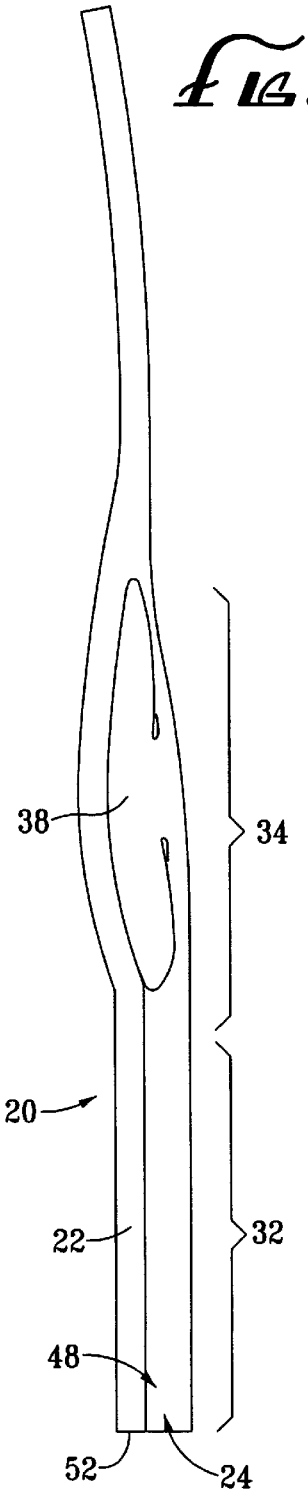
FIG. 4 is a side view of the insole assembly taken at the line 4—4 of FIG. 2.

Referring to FIGS. 2 and 3, an insole assembly 20 of the invention includes a cushioning member 22 formed, e.g., of memory elastic material such as HYTREL® polyester elastomeric expanded foam material, as sold by E. I du Pont de Nemours & Company, Inc. of Wilmington, Del., and an underlying resilient support member 24, also formed, e.g., of HYTREL® polyester elastomeric material.

HYTREL® polyester elastomeric material is an engineering plastic selected for its balance of mechanical properties, i.e. high strength, creep resistance and the ability to perform over a broad service temperature range, and also for its characteristics of flexibility and its high useful elasticity, which has been found to be three to ten times that of other engineering resins.

Referring again to FIGS. 2 and 3, the cushioning member 22 defines an upper surface 26 for engagement by a wearer's foot, with a general contour imitating that of a bottom surface of the wearer's foot at rest and an upraised arch surface 28 positioned for engagement with an arch region of the foot. The cushioning member further defines an undersurface 30 having at least a first region 32 disposed generally beneath a wearer's heel and a second region 34 extending generally beneath a wearer's arch.

Figure 5:
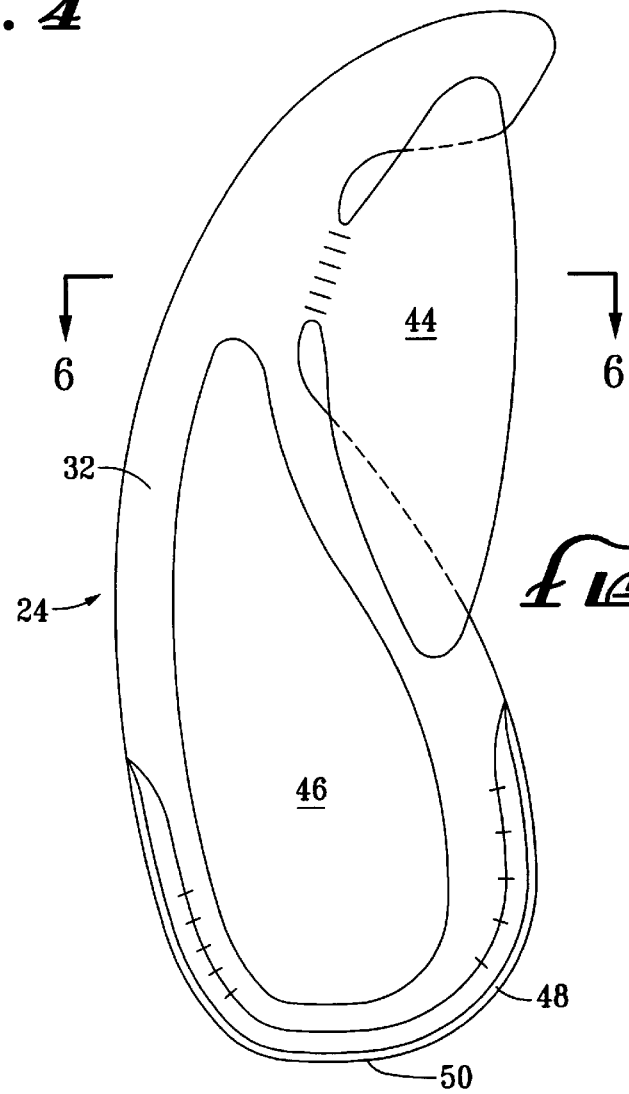
FIG. 5 is a top plan view of the resilient support member of the insole assembly of FIGS. 3 and 4.
Figure 6:
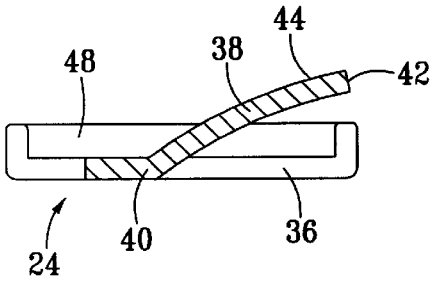
FIG. 6 is an end sectional view of the resilient support member taken at the line 6—6 of FIG. 5.

The resilient support member 24 has a body 36 disposed beneath the first region 32 of the undersurface 30, and a resilient cantilevered arm member 38 with a first end 40 attached to the body 36 and a second end 42 extending beneath the second region 34 of the undersurface 30 and defining an arch support surface 44 (FIG. 5) in supporting engagement with the cushioning member undersurface 30. Referring to FIG. 6, the resilient cantilevered arm member 38 preferably has an arcuate shape in a plane perpendicular to the arch support surface 44.

The body 36 of the resilient support member 24, in the first region 32 beneath the heel, defines an aperture 46 into which the cushioning member 22 engages in a manner to secure the relative positions of the body 36 and the cushioning member. The body 36 further has an upstanding lip or wall 48 extending about a heel end 50 of the body to engage with a side surface 52 of the cushioning member in the heel region to further secure the relative positions of the body and cushioning member, especially during walking and other movement of the foot.

Referring again to FIG. 1 et seq., in a shoe 10 having an insole assembly 20 of the invention, the upper surface 26 of cushioning member 22 has a contour imitating that of a bottom surface of a wearer's foot at rest, with an upraised arch surface 28 positioned to engage and support an arch region of the wearer's foot. The resilient support member 24 is disposed beneath the cushioning member, with the cantilevered arm member 38 advantageously disposed beneath the upraised arch surface. Thus, the support provided by the cantilevered arm member is applied to the arch region of the wearer's foot at rest, and the cantilevered arm member moves in response to stepping forces applied by the foot and thus supports the arch region of the wearer's foot with movement of the foot during walking. The cushioning member 22 also absorbs shock from the force of the wearer's foot driving downward during walking and flexes with the movement of the wearer's foot, the memory elastic nature of the cushioning material serving to permit the cushioning member to recover its "at rest" position and contour imitating the contour of the wearer's foot at rest.

Figure 7:
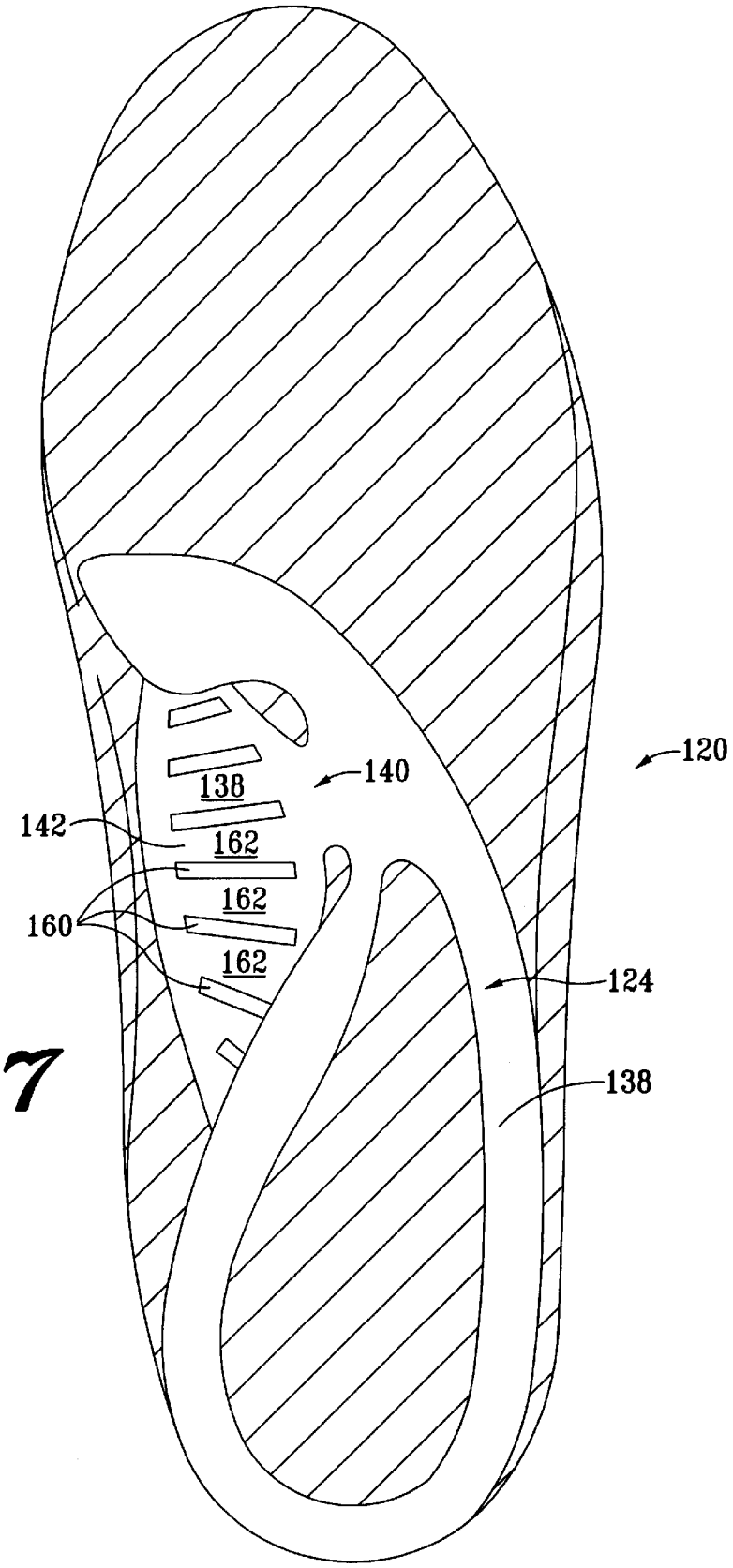
FIGS. 7, 8, 9 and 10 are bottom views of other embodiments of insole assemblies.

The shoe 10 (FIG. 1) may be equipped with an alternative preferred embodiment of an insole assembly of the invention. For example, referring to FIG. 7, in place of insole assembly 20, another preferred insole assembly 120 of the invention includes a cushioning member 122 and an underlying resilient support member 124, both formed, e.g., of HYTREL® polyester elastomeric material.

The structure of insole 120 is analogous to that of insole 20, described above. For example, the cushioning member 122 defines an upper surface with an upraised arch surface positioned for engagement with an arch region of the foot. The cushioning member further defines an undersurface 130 having at least a first region 132 disposed generally beneath a wearer's heel and a second region 134 extending generally beneath a wearer's arch.

The resilient support member 124 has a body 136 disposed beneath the first region 132 of the undersurface 130, and resilient cantilevered arm members 138 each with a first end 142 attached to the body 136 and a second end 140 extending beneath the second region 134 of the undersurface 130 and defining an arch support surface in supporting engagement with the cushioning member undersurface 130. The resilient cantilevered arm members 138 preferably each have an arcuate shape in a plane perpendicular to the arch support surface.

In a shoe 10 having an insole assembly 120 of the invention, the cantilevered arm members provide support to the arch region of the wearer's foot at rest. While the user is walking, the cantilevered arm members respond independently to stepping forces applied by the user's foot to assume relatively different positions and thus support the arch region of the wearer's foot.

While preferred embodiments are described for illustrative purposes, one skilled in the art should recognize many modifications in structure, arrangement, portions, and components used in the practice of the invention and otherwise which are consistent with the principles of the broader appended claims of the invention.

Figure 8:
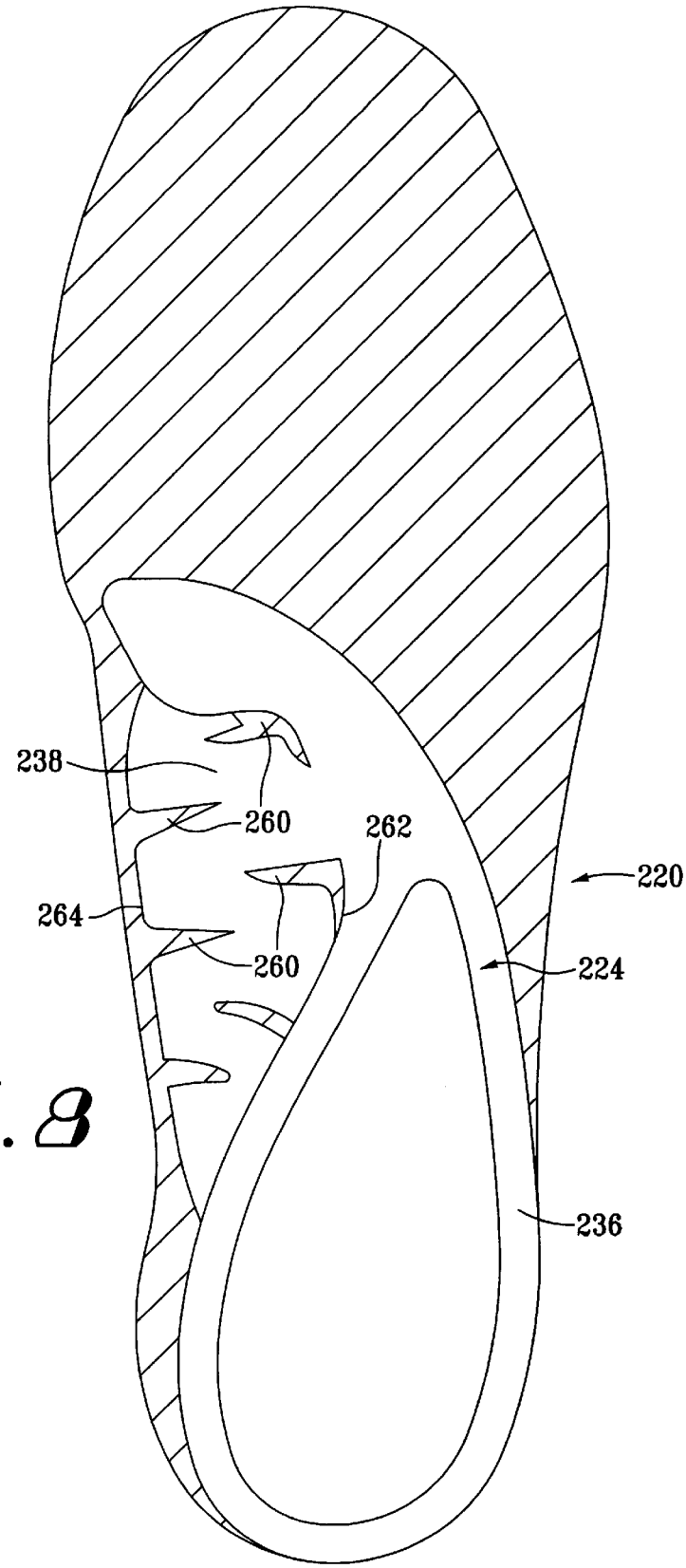

Other embodiments are within the following claims. For example, referring to FIG. 8, in another embodiment of an insole assembly 220 of the invention, a resilient support member 224 has a cantilevered arm 238 with a first end attached to the body 236, and the arm defines a plurality of elongated through apertures 260 that form a plurality of intervening elongated arm segments 262. The arm segments, with ends attached to the arm member, have center portions that are free to flex independently in response to stepping action.

Figure 9:
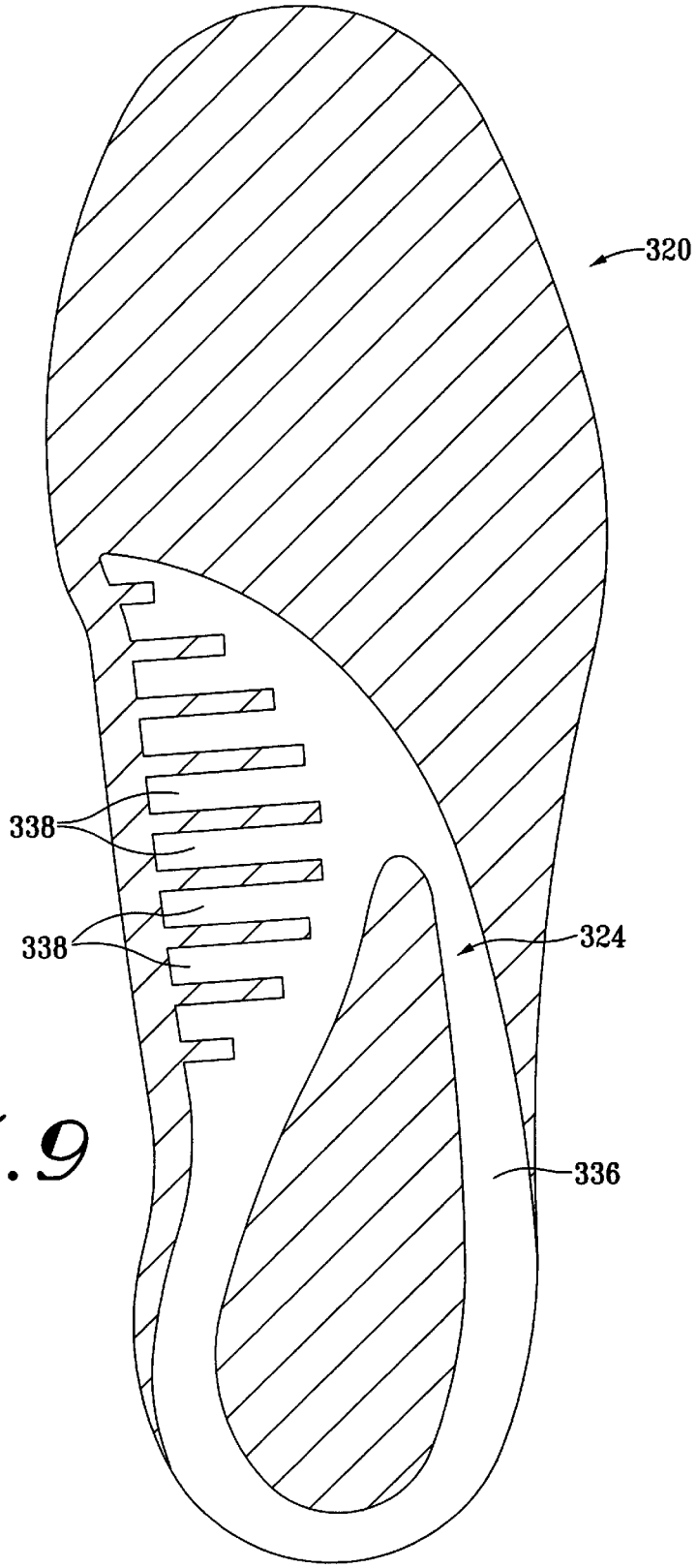

Referring to FIG. 9, in still another embodiment of an insole assembly 320 of the invention, a resilient support member 324 has a cantilevered arm 338 with a first end attached to the body 336, and the arm defines a plurality of elongated slits 360 extending from the inner edge 362 and the outer edge 364 of the arm member to form a plurality of intervening elongated arm segments 366 which allow sections of the arm member to respond relatively independently to local stepping forces.

Figure 10:
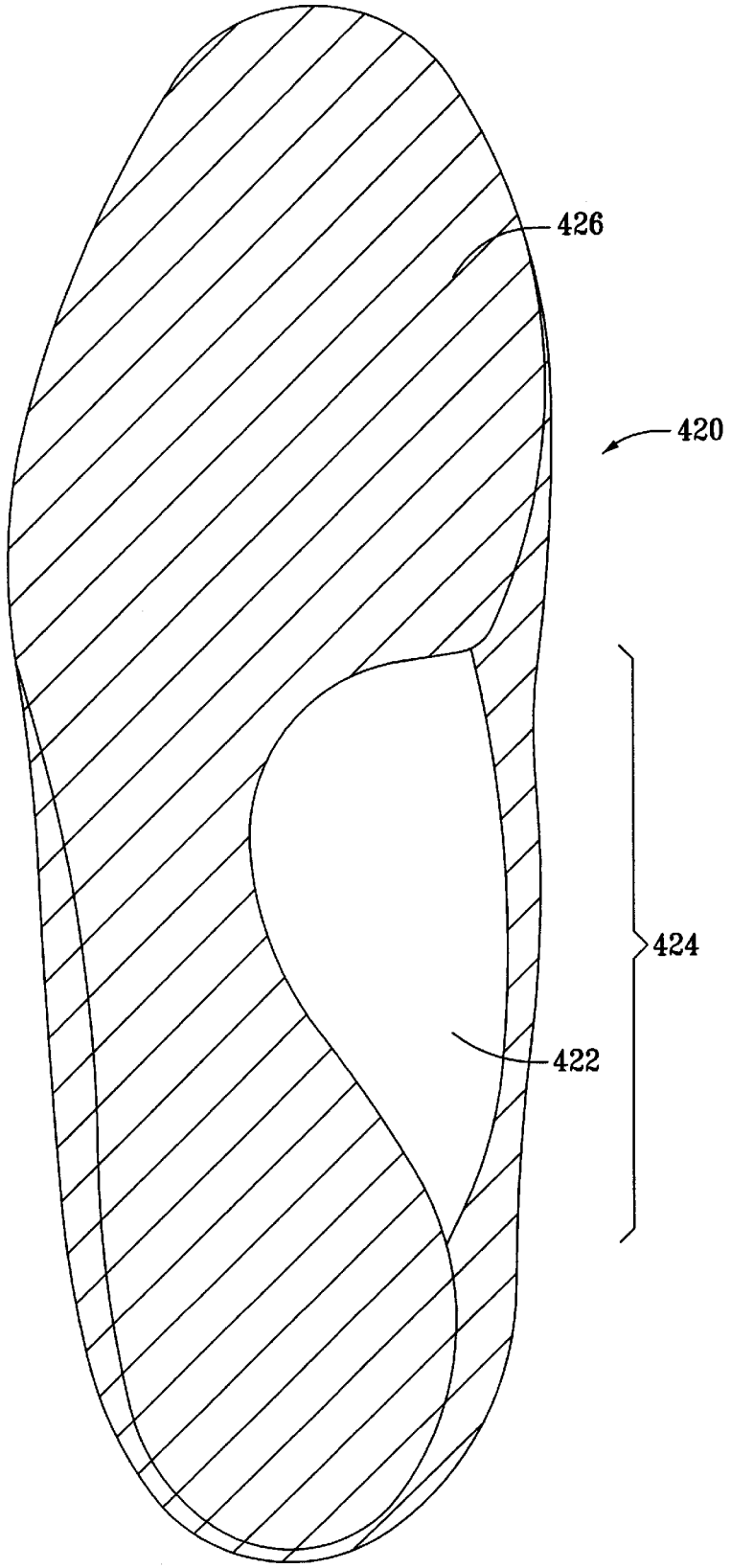

Referring to FIG. 10, an insole assembly 420 has a resilient support member 422 beneath the arch region 424 of a cushioning member 426.

Figure 11:
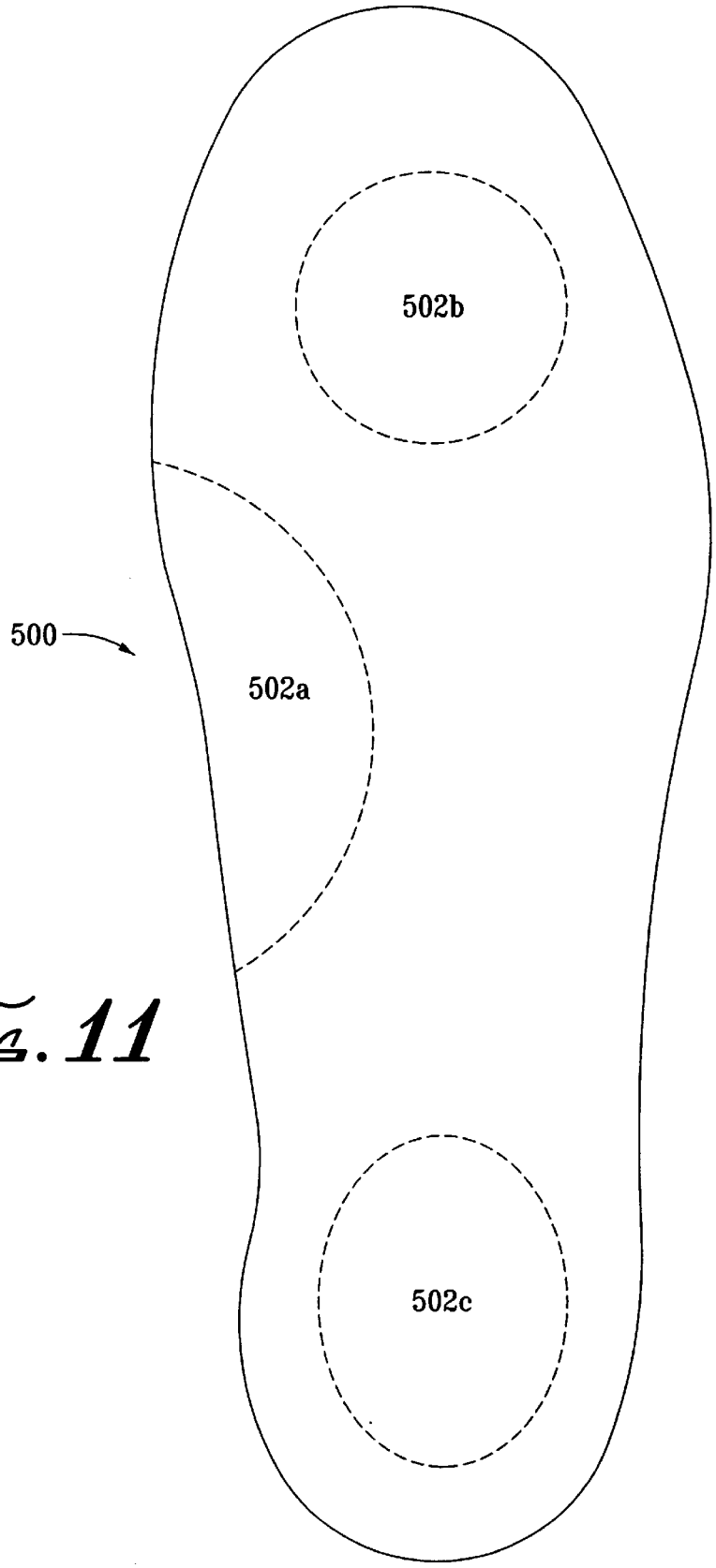
FIG. 11 is a top view of another embodiment of an insole assembly.

Referring to FIG. 11, an insole assembly 500 of the invention may have one or more supported regions 502, e.g. three regions 502*a*, 502*b* and 502*c* are shown, corresponding to the different regions of the wearer's foot for which support is particularly desirable, with a resilient support member advantageously positioned beneath each of these regions of the wearer's foot where support is desired.

What is claimed is:

1. An insole assembly for footwear comprising a cushioning member and an underlying resilient support member, said cushioning member defining an undersurface having at least a first region disposed beneath a wearer's heal and a second region extending beneath a wearer's arch, said resilient support member comprising:

a body disposed beneath said first region of said undersurface, and an array of at least two resilient cantilevered arm members, each resilient cantilevered arm member having a first end attached to said body and a second, free end extending beneath said second region of said undersurface, each said resilient cantilevered arm member, in a region terminating in said free end, defining an upper arch support surface of convex shape relative to a frontal plane of a wearer's body and disposed in supporting engagement with said undersurface beneath a wearer's arch, each said resilient cantilevered arm member of said array of at least two resilient cantilevered arm members adapted to move independently in response to a vertical component of stepping forces between a first, at-rest position and a second, load position by deflecting from said first, at-rest position towards said second, load position upon application of a stepping force load and, when the stepping force load is removed, each said resilient cantilevered arm member of said array of at least two resilient cantilevered arm members is adapted to recover independently and resiliently from said second, load position towards said first, at-rest position, each said cantilevered arm member of said array of at least two resilient cantilevered arm members having a stiffness such that said resilient support member supports the user's arch.

2. The insole assembly of claim 1 wherein said cushioning member further defines an upper surface for engagement by a wearer's foot, with an upraised arch surface positioned for engagement with an arch region of the wearer's foot, said upraised arch surface positioned for resilient support by said arch support surface defined by said resilient cantilevered arm members.

3. The insole assembly of claim 2 wherein said body of said resilient support member, in said first region disposed beneath a wearer's heel, defines an aperture, and said cushioning member is adapted to engage in said aperture in a manner to secure the relative positions of said body and said cushioning member.

4. The insole assembly of claim 3 wherein said body of said resilient support member further comprises an upstanding lip extending about a heel end of said body and adapted to engage with a side surface of said cushioning member in a manner to further secure the relative positions of said body and said cushioning member.

5. The insole assembly of claim 1 wherein said cushioning member comprises memory elastic polymeric material.

6. The insole assembly of claim 5 wherein said memory elastic polymeric material comprises polyester elastomeric expanded foam material.

7. The insole assembly of claim 7 wherein said resilient support member comprises memory elastic polymeric material.

8. The insole assembly of claim 7 wherein said memory elastic polymeric material comprises polyester elastomeric material.

9. A resilient insole support member for footwear having an insole defining an arch support region, comprising:

a body disposed beneath a second region, other than the arch region, of a wearer's foot disposed in the footwear, and an array of at least two resilient cantilevered arm members, each resilient cantilevered arm member having a first end attached to said body and a second, free end extending beneath the arch region of the wearer's foot, each said resilient cantilevered arm member, in a region terminating in said free end, defining an upper arch support surface of convex shape relative to a frontal plane of a wearer's body, each said resilient cantilevered arm member of said array of at least two resilient cantilevered arm members adapted to move independently in response to a vertical component of stepping forces between a first, at-rest position and a second, load position by deflecting from said first, at-rest position towards said second, load position upon application of a stepping force load and, when the stepping force load is removed, each said resilient cantilevered arm member of said array of at least two resilient cantilevered arm members is adapted to recover independently and resiliently from said second, load position toward said first, at-rest position, each said cantilevered arm member of said array of at least two resilient cantilevered arm members having a stiffness such that said resilient support member supports the user's arch.

10. The resilient insole support member of claim 9 wherein said resilient support member comprises memory elastic polymeric material.

11. The resilient insole support member of claim 10 wherein said memory elastic polymeric material comprises polyester elastomeric material.

* * * * *